US006945604B2

(12) United States Patent
Splane, Jr.

(10) Patent No.: US 6,945,604 B2
(45) Date of Patent: Sep. 20, 2005

(54) LIFTING TOILET CHAIR

(75) Inventor: Robson L. Splane, Jr., Valley Center, CA (US)

(73) Assignee: LifeGear, Inc., El Monte, CA (US)

( * ) Notice: Subject to any disclaimer, the term of this patent is extended or adjusted under 35 U.S.C. 154(b) by 0 days.

(21) Appl. No.: 10/715,726

(22) Filed: Nov. 18, 2003

(65) Prior Publication Data

US 2005/0104430 A1 May 19, 2005

(51) Int. Cl.[7] ..... A47C 1/00; A47K 11/04
(52) U.S. Cl. ..... 297/313; 297/330; 297/DIG. 10
(58) Field of Search ..... 297/313, 330, 297/DIG. 10

(56) References Cited

U.S. PATENT DOCUMENTS 2,928,104 A * 3/1960 Kennedy ..... 297/313 X
4,185,335 A * 1/1980 Alvis ..... 297/330 X
4,587,678 A * 5/1986 Love et al. ..... 297/330 X
4,872,223 A * 10/1989 Baird ..... 297/DIG. 10 X
4,884,841 A * 12/1989 Holley ..... 297/DIG. 10 X
4,907,303 A * 3/1990 Baird ..... 297/313 X
5,031,251 A * 7/1991 Williams et al. ..... 297/330 X
5,063,617 A * 11/1991 Ward et al. ..... 297/DIG. 10 X
5,155,873 A * 10/1992 Bridges ..... 297/330 X
5,309,583 A * 5/1994 White et al. ..... 297/DIG. 10 X
5,312,157 A * 5/1994 Logan, Jr. ..... 297/313 X
5,592,703 A * 1/1997 Jones et al. ..... 297/DIG. 10 X
5,626,389 A * 5/1997 Logan, Jr. ..... 297/DIG. 10 X
5,661,858 A * 9/1997 House et al. .... 297/DIG. 10 X
5,803,545 A * 9/1998 Guguin ..... 297/330 X
6,154,896 A * 12/2000 Houston et al. . 297/DIG. 10 X
6,161,229 A * 12/2000 Ryan et al. ..... 297/DIG. 10 X
6,189,164 B1 * 2/2001 Krapu ..... 297/DIG. 10 X
6,385,797 B1 * 5/2002 Phillips ..... 297/DIG. 10 X
6,438,769 B1 * 8/2002 Luckenbill ..... 297/330 X
6,507,961 B1 * 1/2003 Ming-Hwa ..... 297/DIG. 10 X
6,598,246 B1 * 7/2003 Shou ..... 297/DIG. 10 X
6,811,220 B2 * 11/2004 Shea et al. ..... 297/313
2003/0062751 A1 * 4/2003 Shea et al. ..... 297/330
2005/0067869 A1 * 3/2005 Strona ..... 297/330

* cited by examiner

*Primary Examiner*—Rodney B. White
(74) *Attorney, Agent, or Firm*—David L. Davis

(57) ABSTRACT

A lifting toilet chair having arm rests which are utilized to provide a leveraging action to allow the user to control the ascent and descent of a pivoting toilet seat as well as to assist the user in raising himself/herself from a sitting to a standing posture.

10 Claims, 5 Drawing Sheets

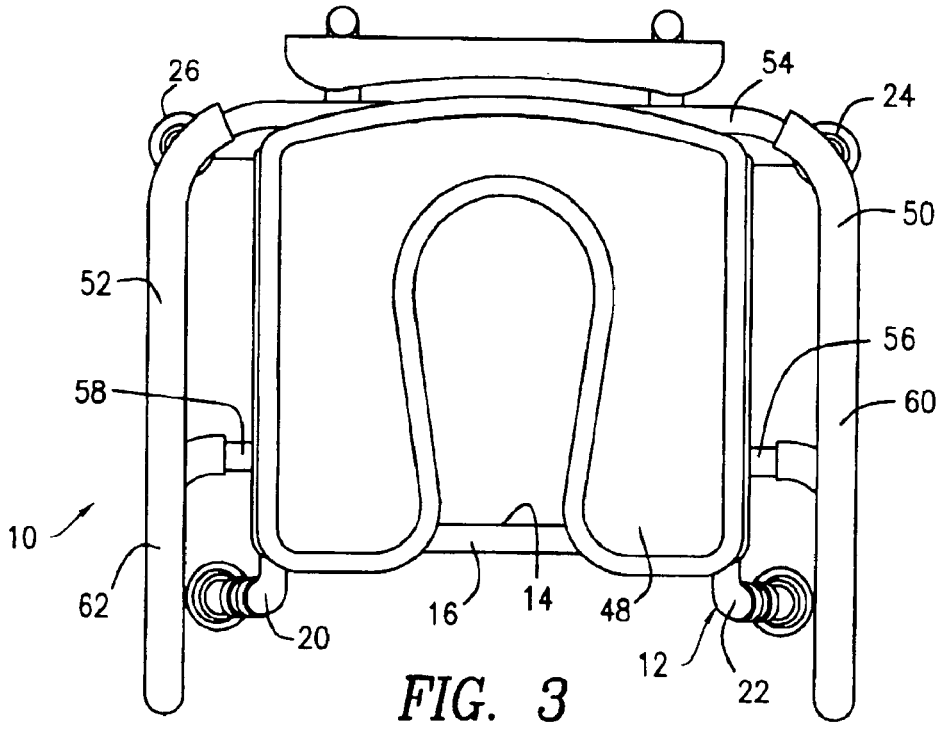
FIG. 3
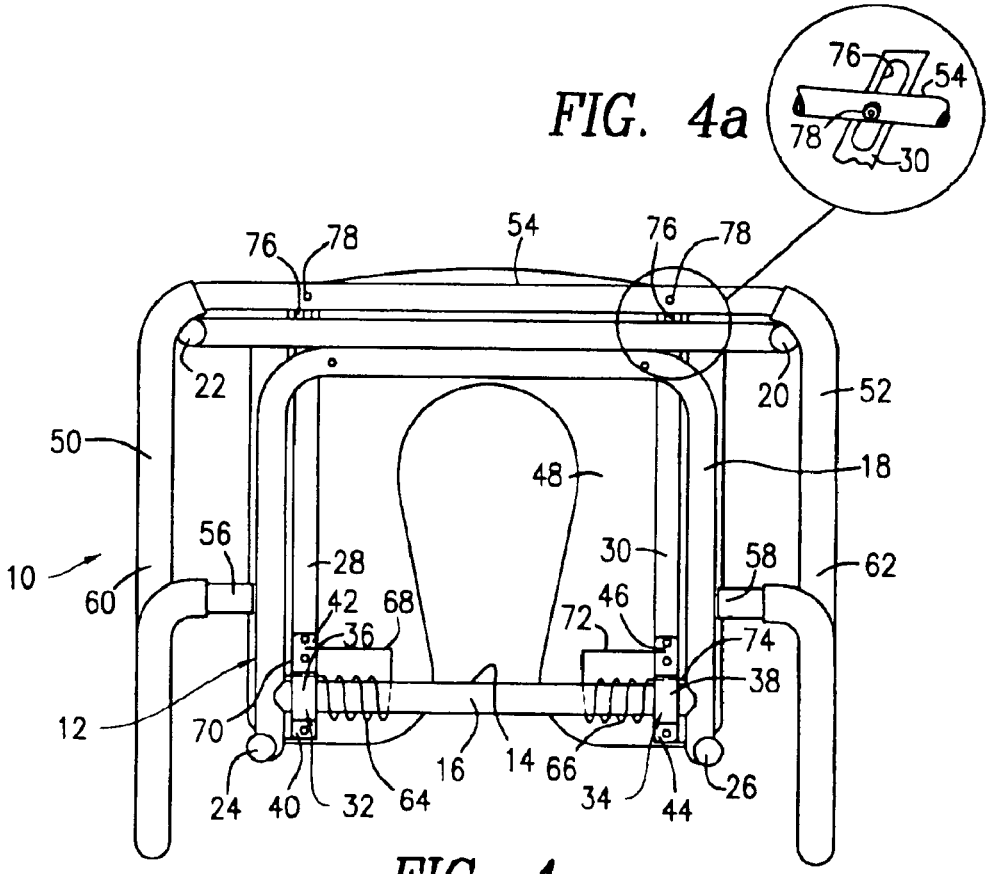
FIG. 4a
FIG. 4

LIFTING TOILET CHAIR

BACKGROUND OF THE INVENTION

This invention relates to a toilet chair for use by people with disabilities and, more particularly, to such a toilet chair which utilizes the strength of the user's arms to assist the user in sitting down and standing up.

As a person ages, his or her physiological functions gradually degrade. Such aging results in spongy bones and reduced bone and muscle supportability. Thus, an older person often finds it difficult to sit down and stand up. Sitting down and standing up are two movements that necessarily occur when a person uses a toilet. For certain older people and persons who have decreased use of their legs, it may be necessary to have an attendant help them sit down and stand up in the course of using the toilet. However, most people would prefer to use the toilet alone without an attendant being present. Fortunately, even people with decreased use of their legs often still retain strength in their arms. It would therefore be desirable to have a toilet chair which makes use of a person's arms to assist the person in sitting down and standing up.

SUMMARY OF THE INVENTION

According to the present invention, there is provided a lifting toilet chair comprising a base frame including an upstanding framework having a generally rectangular horizontal open space at its upper end defined by peripheral members and at least one support member overlying the base frame. The support member is pivotally connected to a top front of the base frame and extends rearwardly beyond a top rear peripheral member of the base frame defining the open space. A toilet seat overlies the open space and is mounted to the support member, and a pair of arm rests laterally flank the toilet seat. Each of the arm rests is coupled at a rearward first point to the support member and is pivotally connected at a forward second point to the base frame, and each of the arm rests has a hand grip portion extending forwardly beyond the second point. Accordingly, when a person is sitting on the toilet seat and desires to stand up, he/she grasps the hand grip portions of the arm rests and presses down, thereby initiating a lever action which causes the toilet seat to pivot upward about the top front of the base frame and press against the person's buttocks to assist in raising the person to a standing posture.

In accordance with an aspect of this invention, the support member is yieldably biased to pivot upwardly away from the base frame.

BRIEF DESCRIPTION OF THE DRAWINGS

The foregoing will be more readily apparent upon reading the following description in conjunction with the drawings in which like elements in different figures thereof are identified by the same reference numeral and wherein:

FIG. 3 is a top plan view of the inventive chair;

FIG. 4 is a bottom plan view of the inventive chair;

FIG. 4*a* is an enlarged detail of a portion of FIG. 4;

DETAILED DESCRIPTION

Figure 1:
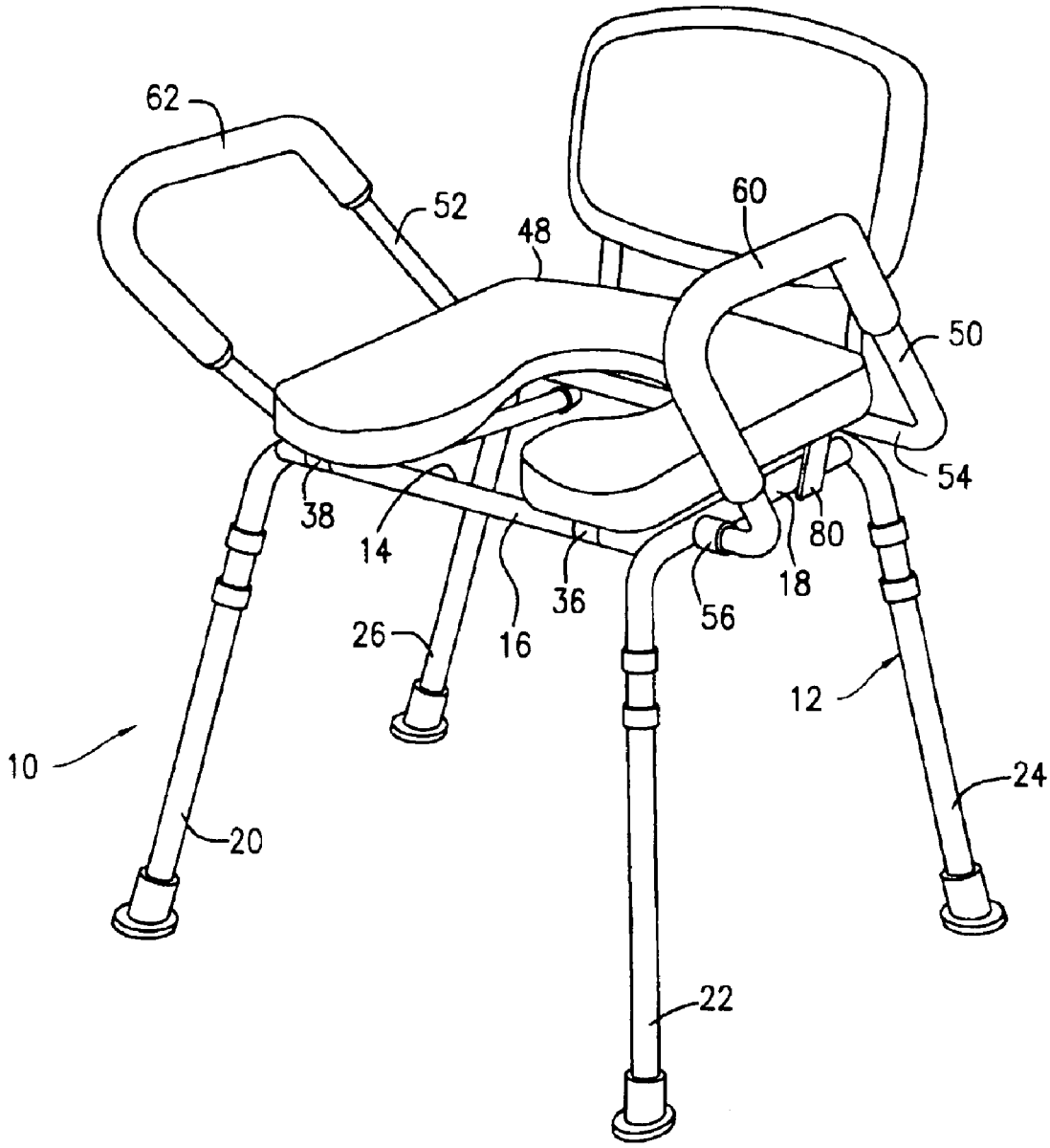
FIG. 1 is a top front perspective view of a preferred embodiment of a lifting toilet chair constructed according to the present invention with the toilet seat in a lowered configuration.

Referring now to the drawings, FIG. 1 shows a lifting toilet chair, designated generally by the reference numeral 10, constructed according to this invention. The chair 10 may be used by placing it directly over an open toilet (not shown) or by suspending an appropriate receptacle (not shown) from its underside. As shown, the chair 10 includes a base frame 12, preferably formed of round tubing and having an upstanding framework with a generally rectangular horizontal open space 14 at its upper end defined by peripheral members 16,18. The upstanding framework includes legs 20,22,24,26 spaced so that they can straddle a conventional toilet. Preferably, the legs 20,22,24,26 are telescopically adjustable so that the height of the chair 10 may be varied to accommodate users and toilets of different size.

A pair of support members 28,30 overlie the base frame 12. Each of the support members 28,30 is formed of a flat, rigid plate strip. The support members 28,30 extend front-to-back parallel to each other and are each pivotally connected to the top front peripheral member 16 of the base frame 12. The pivotal connection of the support members 28,30 to the base frame 12 is provided by the strips 32,34. Each of the strips 32,34 is formed with a respective arcuate portion 36,38 which partially encircles the top front peripheral member 16 of the base frame 12. Each of the strips 32,34 is also formed with flat extensions 40,42,44,46, respectively, which are fixedly secured to the forward end of a respective support member 28,30.

Figure 5:
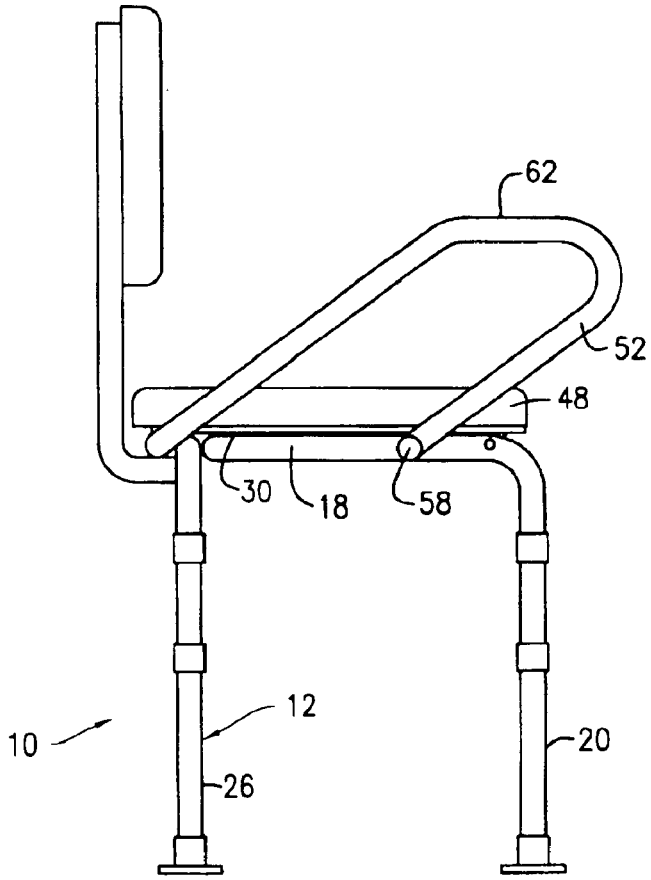
FIG. 5 is a side view of the inventive chair with the toilet seat in a lowered configuration.

The toilet chair 10 also includes a toilet seat 48 which is fixedly secured to the support members 28,30. A pair of arm rests 50,52 laterally flank the toilet seat 48. Preferably, the arm rests 50,52 are formed unitarily from a single length of tubing and are connected together by a joining portion 54. As will be described hereinafter, the arm rests 50,52 are coupled at their lower rearward ends, through the joining portion 54, to the support members 28,30 and are pivotally coupled at their lower forward ends 56,58 to the base frame 12. Each of the arm rests 50,52 has a respective elevated hand grip portion 60,62 which, as best shown in FIG. 5, extends forwardly beyond the respective point of connection 56,58 to the base frame 12. As shown, each of the arm rests 50,52 has its hand grip portion 60,62 on a central portion of the arm rest between a front end and a back end of the central portion. Each of the arm rests 50,52 also has a forward portion extending upwardly and forwardly to the central portion front end from the pivotal connection 56,58 to the base frame 12, and a rearward portion extending upwardly and forwardly to the central portion back end from the joining portion 54. This design of the arm rests 50,52 provides a leveraging action when the user sits down and stands up.

For reasons which will be explained hereinafter, it is desirable to yieldably bias the toilet seat 48 into its raised position where it is pivoted away from the base frame 12. Accordingly, a pair of helical springs 64,66 (FIG. 4) are provided. The springs 64,66 surround the top front peripheral member 16 of the base frame 12. The spring 64 has first and second straight ends 68,70, with the first end 68 contacting the support member 28 and the second end 70 contacting the peripheral member 18 of the base frame 12. Likewise, the spring 66 has first and second straight ends 72,74, with the first end 72 contacting the support member 30 and the second end 74 contacting the peripheral member 18 of the base frame 12. The springs 64,66 are not strong enough to lift the toilet seat 48 with a user supported thereby, but are sufficiently strong to pivot the unoccupied toilet seat 48 upwardly away from the base frame 12.

According to the present invention, the pivoting of the support members 28,30 (and the toilet seat 48) upwardly away from the base frame 12 is limited to an angle of about forty-five (45) degrees to the horizontal. This is accomplished by forming each of the support members 28,30 with an elongated slot 76 near its rearward end, as best shown in FIG. 4*a*. The slot 76 extends in a front to back direction rearwardly beyond the top rear peripheral tubing 18 of the base frame 12. The coupling of the pair of arm rests 50,52 to the support members 28,30 is provided by a pair of rod members 78, which may be in the form of bolts, each secured at a first end to the joining portion 54 and extending through a respective support member slot 76 for sliding movement therealong. As the toilet seat 48 pivots upwardly, the bolts 78 travel forwardly along the slots 76. Accordingly, when the bolts 78 reach the forward ends of the slots 76, this terminates the pivoting of the toilet seat 48. Preferably, the slots 76 are dimensioned so that the bolts 78 reach the forward ends of the slots 76 when the toilet seat 48 has pivoted upwardly to an angle of about forty-five (45) degrees to the horizontal.

Figure 2:
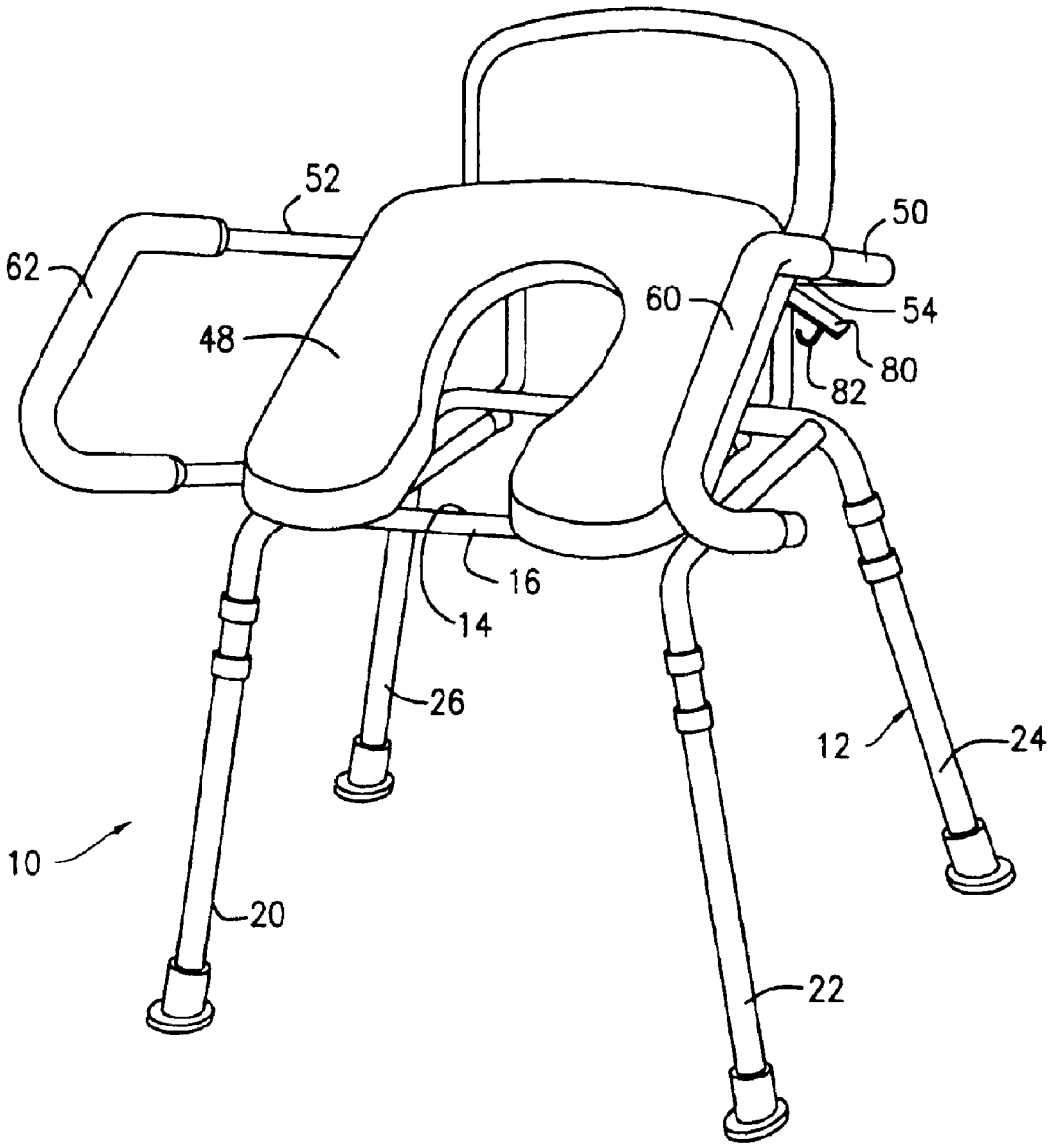
FIG. 2 is a view similar to FIG. 1 with the toilet seat in a raised configuration.
Figure 6:
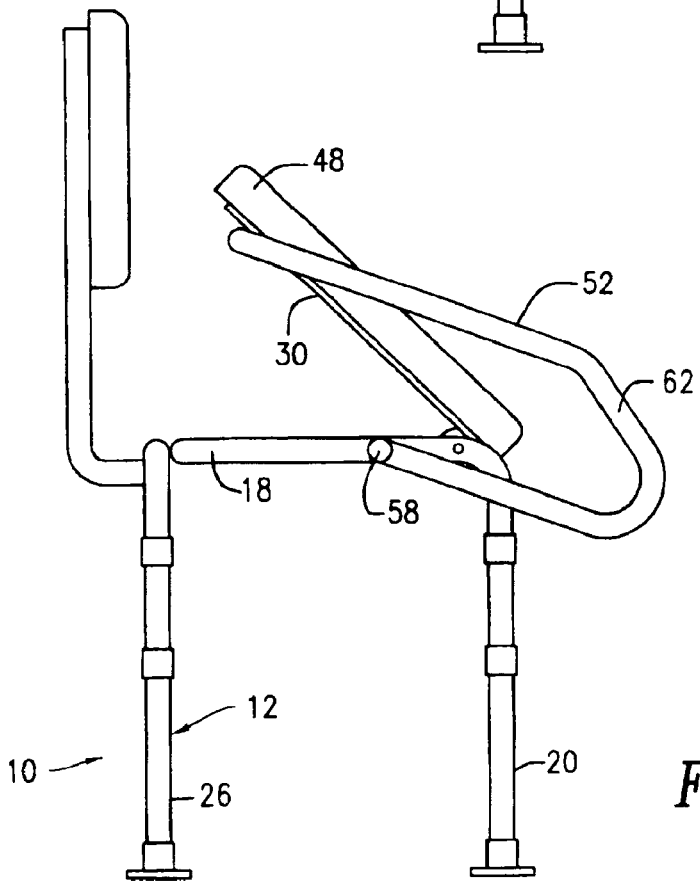
FIG. 6 is a side view of the inventive chair with the toilet seat in a raised configuration.

When not in use, the chair 10 is as shown in FIGS. 2 and 6, with the toilet seat 48 pivoted upwardly to an angle of about forty-five (45) degrees, due to the yieldable biasing force of the helical springs 64,66. A user would then approach the chair 10 and turn so that his/her buttocks are against the toilet seat 48 and his/her hands are on the hand grip portions 60,62 of the arm rests 50,52. By pressing on the hand grip portions 60,62, the user keeps the toilet seat 48 up and prevents a sudden falling. As the user starts to lower himself/herself, continued pressure on the hand grip portions 60,62 controls the descent of the toilet seat 48 and, consequently, the user. When the user desires to stand up from the chair 10, downward pressure on the hand grip portions 60,62 raises the toilet seat 48 and assists in raising the user to a standing posture.

Figure 7A:
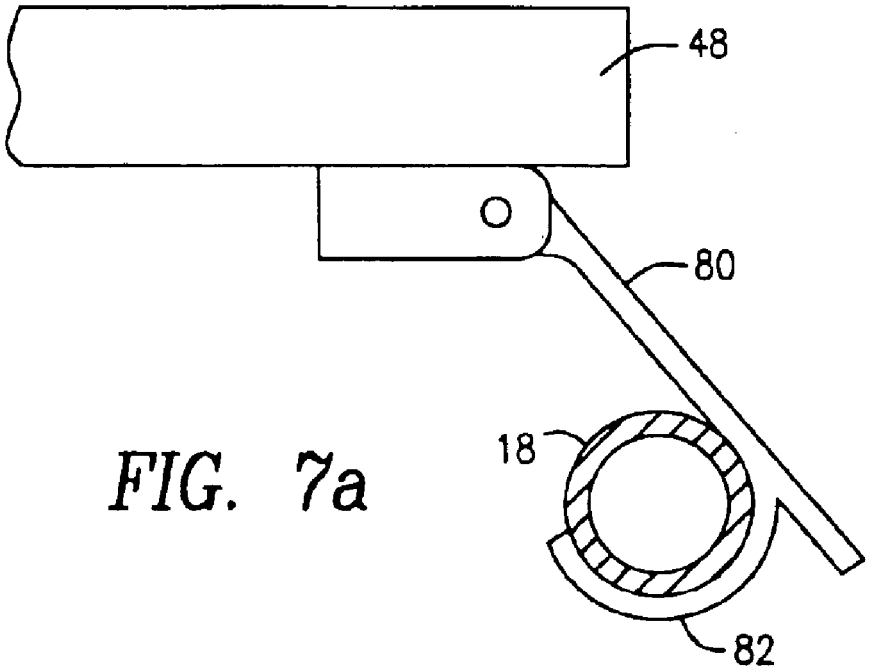
FIGS. 7*a* and 7*b* are enlarged cutaway views showing a latch for maintaining the seat in its lowered configuration.
Figure 7B:
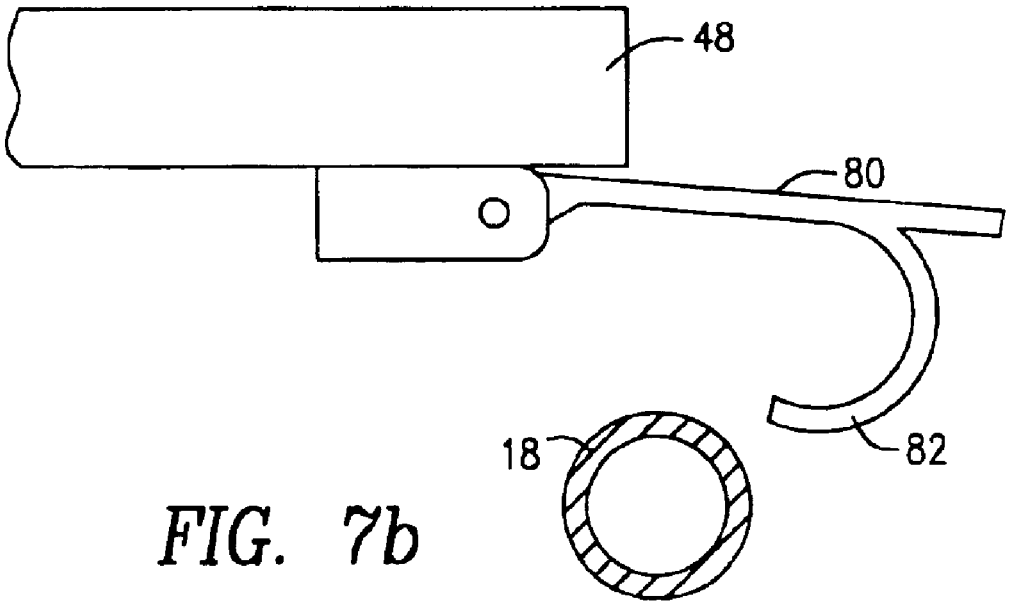

There may be times when it is desired to prevent the toilet seat 48 from pivoting upwardly, for example, when shipping the chair 10 or when using the chair 10 without requiring the lifting action. Accordingly, there is provided a latch 80 (FIGS. 7*a* and 7*b*) which is pivotably secured to the underside of the toilet seat 48 along a side thereof. The latch 80 includes a hook 82 which is engageable with the peripheral tubing member 18 of the base frame 12 in a snap-fit manner when the toilet seat 18 is fully lowered to maintain the toilet seat 48 in the fully lowered orientation until the hook 82 is disengaged from the tubing 18. Hooks 82 may be provided on both sides of the toilet seat 48 to more firmly secure the toilet seat 48 in its lowered orientation.

Accordingly, there has been disclosed an improved lifting toilet chair. While an exemplary embodiment of the present invention has been disclosed herein, it will be appreciated that various adaptations and modifications to the disclosed embodiment are possible, and it is therefore intended that this invention be limited only by the scope of the appended claims.

What is claimed is:

1. A lifting toilet chair, comprising:

a base frame including an upstanding framework having a generally rectangular horizontal open space at its upper end defined by peripheral members;

at least one support member overlying said base frame, said at least one support member being directly pivotally connected to a top front of said base frame and extending rearwardly beyond a top rear peripheral member of said base frame defining said open space;

a toilet seat overlying said open space in a substantially horizontal orientation and being fixedly secured to said at least one support member so that said toilet seat pivots to a substantially vertical orientation relative to said base frame as said at least one support member pivots relative to said base frame; and a pair of arm rests laterally flanking said toilet seat, wherein each of said arm rests is coupled at a rearward first point to said at least one support member and is pivotally connected at a forward second point to said base frame, and wherein each of said arm rests has a hand grip portion extending forwardly beyond said second point.

2. The lifting toilet chair according to claim 1 further comprising:

means for yieldably biasing said at least one support member to pivot upwardly away from said base frame.

3. The lifting toilet chair according to claim 2 wherein:

said base frame is formed of round tubing; and said biasing means includes a helical spring surrounding the top front tubing of said base frame, said spring including first and second straight ends with a first end contacting said at least one support member and a second end contacting said base frame.

4. The lifting toilet chair according to claim 2 further comprising means for limiting the upward pivoting of said at least one support member away from said base frame to an angle of about forty-five (45) degrees to the horizontal.

5. The lifting toilet chair according to claim 2 further comprising a latch selectively coupled between said toilet seat and said base frame for retaining said toilet seat in a lower orientation adjacent said base frame against the biasing force of said biasing means.

6. The lifting toilet chair according to claim 1 wherein each of said arm rests includes:

a central portion having a front end and a back end with said hand grip portion being between said front and back ends;

a forward portion extending upwardly and forwardly to the central portion front end from the pivotal connection to said base frame; and a rearward portion extending upwardly and forwardly to the central portion back end from the coupling to said at least one support member.

7. The lifting toilet chair according to claim 6 wherein:

said pair of arm rests are joined by a joining member extending between the distal ends of the rearward portions of said pair of arm rests; and said pair of arm rests and said joining member are all unitarily formed from a single length of tubing.

8. The lifting toilet chair according to claim 1 wherein:

said base frame is formed of round tubing;

each of said at least one support member comprises a respective plate member; and the pivotal connection of each of said at least one support member to said base frame is provided by a respective strip formed to at least partially encircle tubing of the top front of said base frame, said strip including at least one flat extension fixedly secured to a forward end of a respective plate member.

9. The lifting toilet chair according to claim 8 wherein:

there are two parallel plate members each adjacent a respective lateral side of said open space;

each of said parallel plate members is formed with an elongated open slot extending in a front to back direction rearwardly beyond the top rear peripheral tubing of said base frame;

said pair of arm rests are joined by a joining member extending between the rearward ends of said pair of arm rests and below said parallel plate members;

said pair of arm rests and said joining member are all unitarily formed from a single length of tubing; and the coupling of said pair of arm rests to said at least one support member is provided by a pair of rod members each secured at a first end to said joining member and extending through a respective parallel plate member slot for sliding movement therealong.

10. A lifting chair, comprising:

a base frame including an upstanding framework having a generally rectangular horizontal open space at its upper end defined by peripheral members;

at least one support member overlying said base frame, said at least one support member being directly pivotally connected to a top front of said base frame and extending rearwardly beyond a top rear peripheral member of said base frame defining said open space;

a seat overlying said open space in a substantially horizontal orientation and being fixedly secured to said at least one support member so that said seat pivots to a substantially vertical orientation relative to said base frame as said at least one support member pivots relative to said base frame; and a pair of arm rests laterally flanking said seat, wherein each of said arm rests coupled at a rearward first point to said at least one support member and is pivotally connected at a forward second point to said base frame, and wherein each of said arm rests has a hand grip portion extending forwardly beyond said second point.

* * * * *